United States Patent [19]

Frutiger

[11] 4,149,035

[45] Apr. 10, 1979

[54] METHOD AND APPARATUS FOR ENCIPHERING AND DECIPHERING AUDIO INFORMATION

[76] Inventor: Peter Frutiger, Sonnahlde 18, Wangen, Switzerland

[21] Appl. No.: 802,427

[22] Filed: Jun. 1, 1977

[30] Foreign Application Priority Data

Jun. 1, 1976 [CH] Switzerland ..... 6893/76

[51] Int. Cl.[2] ..... H04R 1/06

[52] U.S. Cl. ..... 179/1.5 R; 178/22; 179/1.5 S

[58] Field of Search ..... 179/1.5 R, 1.5 S; 178/22; 325/32

[56] References Cited

U.S. PATENT DOCUMENTS

| | | | |
|---|---|---|---|
| 2,586,475 | 2/1952 | Milliquet | 179/1.5 R |
| 3,696,207 | 10/1972 | Lundin et al. | 178/22 |
| 3,798,360 | 3/1974 | Feistel | 178/22 |
| 3,921,151 | 11/1975 | Guanella | 178/22 |
| 3,991,271 | 11/1976 | Branscome et al. | 179/1.5 R |

*Primary Examiner*—Howard A. Birmiel

*Attorney, Agent, or Firm*—Ostrolenk, Faber, Gerb & Soffen

[57] ABSTRACT

A method of, and apparatus for, enciphering and deciphering audio information which is subdivided into partial blocks along a time axis, the partial blocks being mutually interchangeable according to key information. The incoming analog audio signals are subdivided into a number of frequency bands, each of which is assigned to an information channel. The analog audio signals of each information channel are converted into digital signals which are subdivided into main blocks along the time axis. The main blocks of equal time of each information channel are subdivided into sub-sections of the same magnitude with respect to time and which are interchanged, in accordance with the key information with sub-sections of the same main block or with sub-sections of a time-equal (i.e. isochronal) main block of another information channel. After the interchange in each information channel, the digital signals are converted into analog signals and the interchanged sub-sections are group together into new main blocks, in order to render possible a further processing of the time-equal or isochronal new main blocks of each information channel.

8 Claims, 3 Drawing Figures

INPUT
50
BRANCHING FILTER
7
8
9
8a
9a
$I_1$
$I_2$
A/D-CONVERTERS
10
11
10a
11a
CLOCK GENERATOR
14
13
KEY CHARACTER GENERATOR
12a
STORAGE CIRCUIT
12
D/A-CONVERTERS
16
15
BRANCHING NETWORK
17
19
18
OUTPUT
60

METHOD AND APPARATUS FOR ENCIPHERING AND DECIPHERING AUDIO INFORMATION

BACKGROUND OF THE INVENTION

The present invention relates to a new and improved method of enciphering and deciphering audio information which is subdivided into partial blocks along a time axis, the partial blocks being mutually interchanged according to key information, and wherein the incoming analog audio signals are subdivided into a number of frequency bands each of which is assigned an information channel. This invention also relates to apparatus for the performance of the aforesaid method which incorporates at least one input side-branching filter for subdividing the incoming analog audio signals into a number of frequency bands each determining a respective information channel.

The heretofore known methods and apparatuses for enciphering speech sounds are essentially subdivided into two groups:

The first group contemplates converting the analog speech signals into digital signals, for instance by means of a so-called vocoder (voice coder), a pulse-code-modulation system (PCM-modulation system) or a delta-modulation system. The pulses are linked or coupled in conventional manner with one another by means of key pulses which are generated by a key generator. The thus enciphered characters are transmitted to the receiver end or side of the system and at that location converted, in appropriate manner, again into deciphered analog speech signals.

This group of prior art equipment affords the advantage of a high quality of the tone or sound and a high redundancy of the transmitted information. Moreover, there are so many possible variations during enciphering, that the security against decryption is extremely high.

The foregoing prior art systems have several drawbacks; a large bandwidth is required for transmission purposes and the equipment is sensitive to phase shifts in the transmission system.

According to a second group of prior art equipment the analog speech signals are not transformed into digital signals. The speech information is subdivided into partial groups along the frequency axis and/or time axis. These partial groups are then permutated by a key information generated by a key generator, so that there is produced a new sequence of the partial groups. Yet, the information as such is still accommodated within the same frequency band and is of the same nature as the original speech information. As a result, there can be employed for the transmission of the information, without disadvantage, transmission systems for speech transmission possessing a corresponding limited bandwidth.

Consequently, there is realized the advantage that extremely large bandwidths are not required for transmission, and phase shifts in the transmission system have practically no influence upon the quality of the transmitted information.

Yet, the second group of equipment is associated with the drawbacks that the variation possibilities for permutation of the partial groups is relatively limited, so that there is hardly possible realization of any effective security against improper access to the plain text information by unauthorized third persons.

SUMMARY OF THE INVENTION

It is a primary object of the present invention to provide an improved method of, and apparatus for, enciphering and deciphering audio information in a manner not associated with the aforementioned drawbacks and limitations of the prior art proposals.

Yet another significant object of the present invention aims at an improved method of, and apparatus for, enciphering and deciphering audio information in an extremely efficient, reliable and accurate manner affording high security against decryption.

Still a further significant object of the present invention aims at the provision of an improved method of, and apparatus for, enciphering and deciphering audio information such that the enciphering and deciphering steps are accomplished in a highly accurate and reliable manner, while safeguarding against decryption of the transmitted information, but nonetheless ensuring for high quality and accuracy in the information transmission.

A further object of this invention proposes the provision of apparatus for enciphering and deciphering audio information in an accurate, reliable and efficient manner, safeguarding against decryption of the enciphered information, and which apparatus is relatively simple in construction and design, extremely efficient and reliable in operation, not readily subject to breakdown and malfunction and requires a minimum of servicing and maintenance.

Another extremely important object of the invention concerns a novel of, and apparatus for enciphering and deciphering audio information, especially voice information, rendering possible great security against decryption, without there being required for the transmission of the information transmission channels possessing bandwidths which are considerably greater than the bandwidth needed for the transmission of the voice information.

BRIEF DESCRIPTION OF THE INVENTION

Now in order to implement these and still further objects of the invention, which will become more readily apparent as the description proceeds, the method aspects of the present development are manifested by the features that the analog audio signals of each information channel are converted into digital signals which are subdivided along the time axis into main blocks. The time-equal or isochronal main blocks of each information channel are subdivided into subsections of the same time dimension or magnitude and are interchanged according to key information with subsections of the same main block or with sub-sections of a time-equal main block of another information channel. After the interchange in each information channel there is accomplished a conversion of the digital signals into analog signals and grouping or placing together the interchanged sub-sections into new main blocks, in order to render possible further processing of the time-equal new main blocks of each information channel.

As already alluded to above, the invention is not only concerned with the aforementioned method aspects, but also deals with apparatus for the performance of such method, which apparatus according to the present invention is manifested by the features that after the branching or separating filter there is arranged an analog to digital converter in each information channel for the conversion of the analog audio signals into digital signals. A storage circuit stores the pulse series from the analog to digital converters. This storage circuit subdivides the stored pulse series of each information channel into main blocks as a function time and these main blocks are subdivided into sub-sections of the same type. Additionally, there is provided a key generator for generating a key information which is delivered to the storage circuit. The storage circuit embodies a circuit arrangement which accomplishes an interchange of the sub-sections of each main block with sub-sections of the same main block or with sub-sections of a time-equal or isochronal main block of another information channel in accordance with the received key information. A digital to analog converter is connected after the storage circuit in each information channel for converting the digital signals into analog signals, and at the output of each information channel there appear for further processing new time-equal main blocks formed from interchanged sub-groups.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
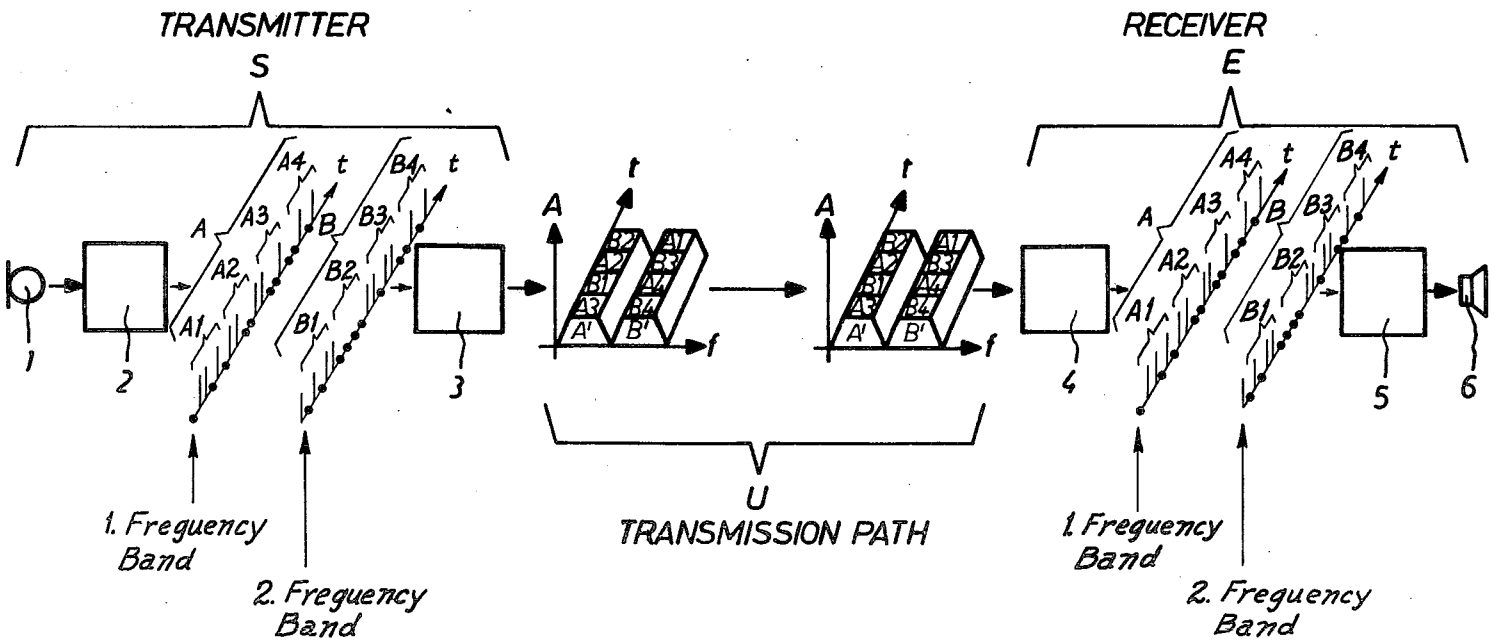
FIG. 1 schematically illustrates an installation or arrangement for the enciphering, transmission and deciphering of audio information.

Referring now to the drawings, FIG. 1 schematically illustrates an system for the enciphering, transmission and deciphering of audio information. At the transmitter end or side S of the system there is provided an electro-acoustical transducer 1, for instance a microphone, which converts the sound waves into audio frequency voltages. The analog audio signals appearing at the output of the transducer 1 are subdivided into two or more frequency bands by a first circuit component 2 arranged at the transmitter end and which will be described more fully hereinafter. The analog signals of each frequency band are converted into digital signals which are subdivided along the time axis into the main or primary blocks A and B. Each main block A and B is subdivided into a given number of sub-sections of the same time magnitude or dimension. In the example shown, the main blocks are subdivided into four sub-sections 1–4. At a second transmitter end-circuit arrangement 3, also described more fully below, the sub-sections 1–4 of the main blocks A and B are interchanged with sub-sections of the same main block and/or with sub-sections of a time-equal or isochronal main block of another frequency band, and such interchange occurs according to key information produced by a key generator. In this second circuit arrangement 3 there subsequently is accomplished a conversion of the digital signals of the interchanged sub-sections into analog signals and a grouping together of the interchanged sub-groups into new main groups A′ and B′. These new main groups A′ and B′ are transmitted by means of the transmission path U to the receiver side or receiver end E of the system.

The incoming or arriving main blocks A′ and B′ are subdivided in a first receiver end-circuit arrangement 4 into a number of frequency bands corresponding to the transmitter end 5. The analog signals at each main block A′ and B′ are converted into digital signals in the circuit arrangement 4, which again are divided into main blocks which in turn are subdivided into sub-sections. Moreover, the interchanged sub-sections 1–4 of the time-equal main blocks A′ and B′ are again interchanged according to key information, which is generated by a key generator and corresponding to the key information used at the transmitter end S, in such a manner that the sequence of the sub-sections 1–4 of each main block A and B again corresponds to the original sequence prevailing at the transmitter end S. In a second receiver end-circuit arrangement 5 the digital signals of the main blocks A and B are again converted into analog signals, which are likewise again converted by means of an electro-acoustical transducer 6 (loudspeaker) into audio output.

On the basis of the block circuit diagram of FIG. 2 there will be described hereinafter the transmitter end-apparatus for enciphering the audio information.

The analog non-enciphered audio signals arriving at the input 50 (and emanating from an electro-acoustical transducer 1-FIG. 1), are subdivided by means of a branching or separating filter 7, composed of two filters 8 and 9 or equivalent means, into two frequency bands. Each frequency band determines an information channel $I_1$ and $I_2$ respectively. The branching or separating filter 7 has arranged at the output side or outputs **8*a* and 9*a* thereof, in each information channel $I_1$ and $I_2$, an analog to digital converter 10 and 11, respectively, which converts the analog signals into digital signals. The digitalizing of the analog audio information can be accomplished in conventional manner, for instance, in accordance with the modified delta-technique described in Swiss Pat. No. 542,552, the disclosure of which is incorporated herein by reference. The pulse series appearing at the outputs 10*a* and 11*a*, respectively, of the converters 10 and 11 are subdivided into the previously mentioned main blocks A and B which are stored in a storage circuit 12. Each main block A and B is subdivided into a given number of sub-sections A1–A4 and B1–B4 respectively, of the same time dimension or magnitude, as such has been shown in FIG. 3 and already previously discussed in conjunction with FIG. 1. Each sub-section 1–4 is formed, for instance, from a fixed number of bits, analogous to the five-unit or seven-unit code, which serves for the CCITT-telegraph code number 2 and number 5**, respectively, for portraying a character.

The storage circuit 12 comprises a circuit arrangement, generally designated by reference character **12*a*, in which there are permutated the sub-sections A1–A4 and B1–B4 of the time-equal or isochronal main blocks A and B (FIG. 3**) with sub-sections of the same main block or with sub-sections of a main block of the other information channel. This permutation is possible since the pulse packages forming the individual sub-sections are neutral with respect to time and frequency.

The permutation of the sub-sections occurs on the basis of a key information which is generated by a key generator 13. Generation of this key information, which is continuously changed, occurs in a well known manner from the cryptology art. A clock generator 14 serves to synchronize the storage circuit 12 and the key generator 13.

After the permutation of the sub-sections A1–A4 and B1–B4, the pulses of such sub-sections in each information channel $I_1$ and $I_2$ respectively, are delivered to the digital to analog converters 15 and 16 respectively, where there is accomplished a conversion of the digital signals into analog signals. This digital to analog conversion is accomplished in the same manner as the analog to digital conversion in the converters 10 and 11.

The sub-sections which are grouped together into the new main or primary blocks A' and B' (FIG. 1) appear in each information channel $I_1$ and $I_2$, respectively, in the form of a continuous analog signal which is delivered to an output branching network 17 composed of two filters 18 and 19. In this output branching network 17 the analog signals at each information channel $I_1$ and $I_2$ are grouped together. The signals appearing at the output 60, which constitute enciphered audio information, are transmitted in any suitable and conventional manner to the receiver end. The time-equal main blocks A' and B' are thus transmitted in parallel.

The previously described apparatus encompasses both of the circuit arrangements 2 and 3 illustrated in FIG. 1.

Figure 2:
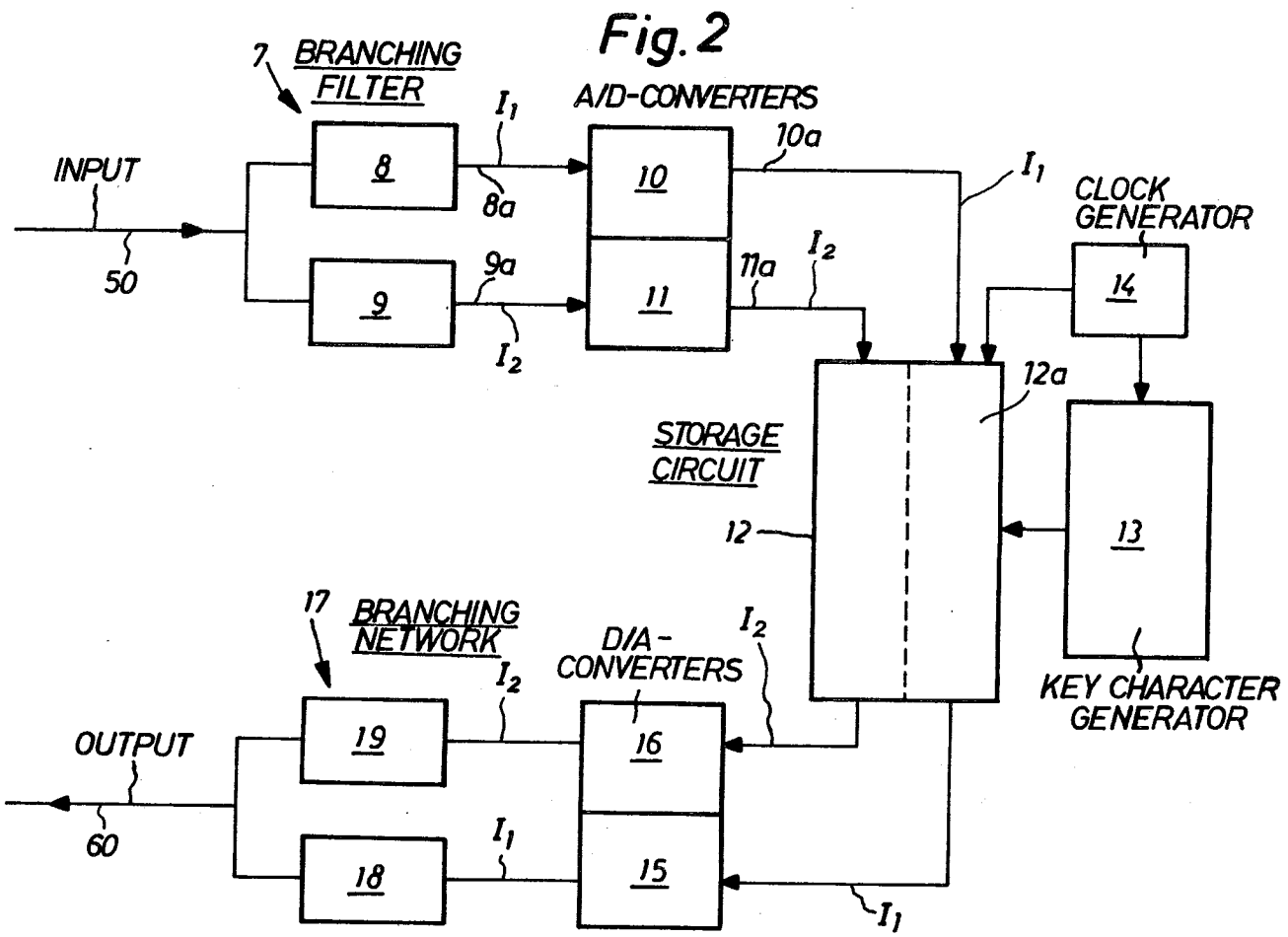
FIG. 2 is a block circuit diagram of apparatus for the enciphering and deciphering of audio information.

The apparatus shown in FIG. 2 can be correspondingly employed for deciphering the enciphered analog signals arriving at the input 50, and the function corresponds to the above described mode of operation or function. At the output 60 there then appear the deciphered plain analog signals which can be converted into audible sound in the electro-acoustical transducer 6 (FIG. 1). In this case the apparatus according to FIG. 1 embodies the circuit arrangements 4 and 5 according to FIG. 1.

Figure 3:
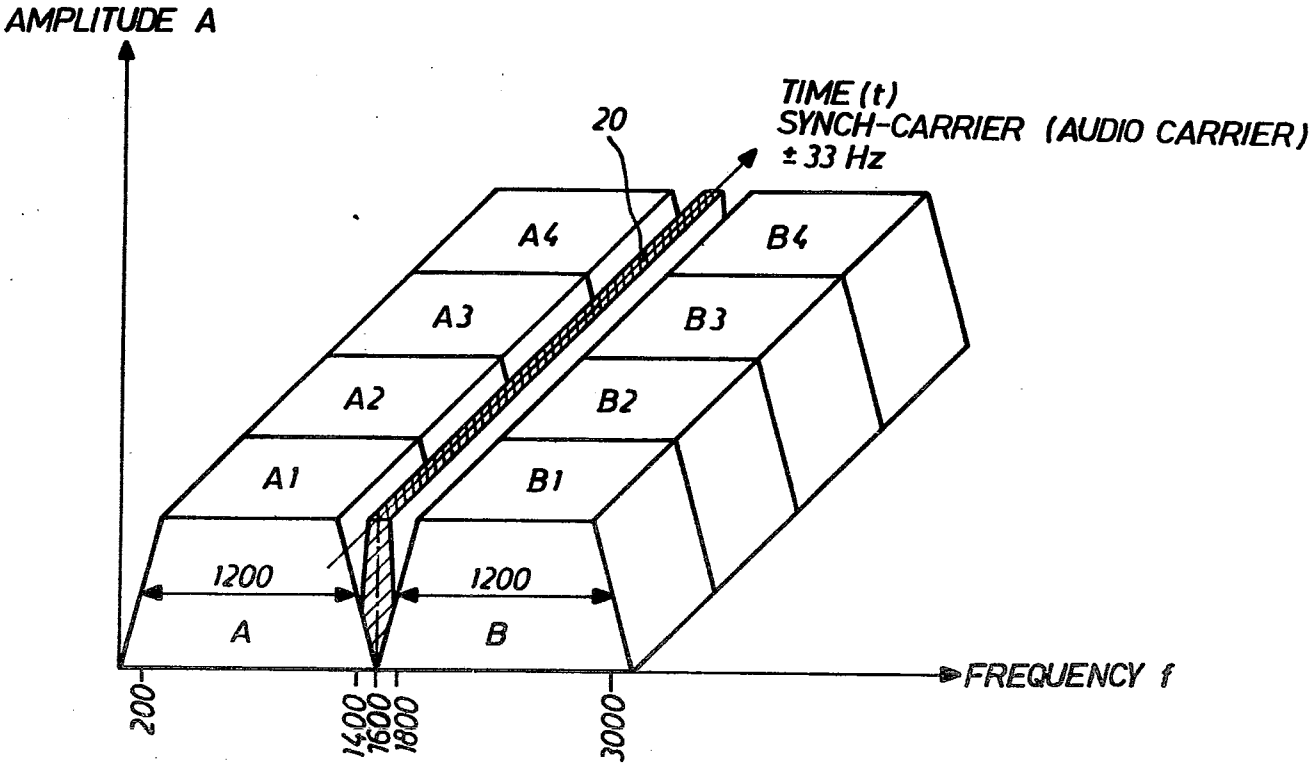
FIG. 3 is a graph depicting two time-equal or isochronal main blocks of the audio information, these main blocks being subdivided into sub-groups.

In order to ensure for proper deciphering at the receiver end of the system of the audio information which has been enciphered at the transmitter end, both of the key generators at the receiver end and the transmitter end must be synchronized with one another. This synchronization can be accomplished in different ways. With the described subdivision into a number of, i.e. at least two frequency bands, it is for instance possible to provide an audio carrier between the two frequency bands. In FIG. 3 this audio carrier has been designated by reference character 20 and is inserted at 1600 Hz between both frequency bands illustrated by the main blocks A and B. This audio carrier is frequency modulated with a small frequency swing or deviation. This frequency modulated audio carrier is transmitted to the receiver end while arranged in each instance between two time-equal or isochronal main blocks.

The frequency modulation serves in conventional manner for the synchronization of the key generator at the receiver end. The carrier itself can simultaneously serve as the reference frequency for the receiver end-equipment and its peak can serve as the reference peak. This is of advantage when the transmission is accomplished by means of radio relay links, and the receiver end-equipment is not quartz stabilized. In the case of plain text information slight frequency deviations are of no significance, since humans are also capable of still recognizing voice information which has been considerably shifted in frequency. In the case of enciphering devices this is however not true. Due to the audio carrier it is now however possible, by means of automatic frequency-correction techniques, which generally are known from the high frequency region (AFC) and now employed in the low-frequency region, to shift the receiver end-incoming signals into a frequency position which is proper for the receiver.

In order to carry out the previously described synchronization, the transmitter end-enciphering device must possess an audio generator for producing the audio carrier and an appropriate device for frequency modulation. The receiving deciphering device must be appropriately equipped with a demodulation device as a frequency-correction device.

In a similar manner the amplitude of the audio carrier will, at the receiving deciphering device, be used as a reference to control an automatic gain control (AGC) device in order to enter at a correct level, proper for further processing, the incoming enciphered information.

The described system has the advantage that a multiplicity of variation possibilities exist during the permutation of the sub-sections. With the described exemplary embodiment employing two frequency bands and four sub-sections for each main block there result 8 = approximately $4 \times 10^4$ permutations, which, with appropriate construction of the key generator, provides extreme security against unauthorized deciphering.

It is possible to subdivide the arriving audio signals into more than two frequency bands and/or to subdivide the main blocks of each frequency band into more than four sub-sections. In this way there is considerably increased the number of possible permutations.

Deciphering by correlation is rendered extremely difficult with the described installation, since the available enciphered information is formed of a sequence of pulse packages which have a neutral behaviour as concerns time and frequency.

The described installation does not utilize any mechanically moved parts and requires only conventional audio channels for the transmission of the enciphered information.

While there are shown and described present preferred embodiments of the invention, it is to be distinctly understood that the invention is not limited thereto, but may be otherwise variously embodied and practiced within the scope of the following claims.

What is claimed is:

1. A method for enciphering and deciphering analogue audio information, said method comprising the steps of:

subdividing said analogue audio information into a plurality of frequency bands, each of said frequency bands representing a different analogue information channel;

converting each of said analogue information channels into a respective train of digital signals, each said trains of digital signals representing a different digital information channel;

subdividing each of said digital information channels into a plurality of main blocks, each of said main blocks having the same time duration and being synchronous with a main block in each of the remaining said digital information channels;

subdividing each of said main blocks into an equal number of subsections, each of said subsections being of equal time duration;

permutating said subsections of each of said main blocks with subsections of its own main block and with subsections of other said main blocks which are synchronous therewith in accordance with key information so as to form a plurality of permutated digital information channels equal in number to said digital information channels;

converting each of said permutated digital information channels into respective second analogue information channels; and combining said second analogue information channels into a single permutated analogue signal for further processing.

2. The method of claim 1, further comprising the steps of:

separating said single permutated analogue signal into a third plurality of analogue information channels corresponding to said second analogue information channels;

converting each of said third plurality of analogue information channels into respective reformed permutated digital information channels, each of said reformed permutated digital information channels comprising a plurality of subsections of equal time duration and corresponding to a different one of said permutated digital information channels;

permutating said reformed permutated second digital information channels so as to form a second plurality of digital information channels corresponding to said digital information channels;

converting each of said second plurality of digital information channels into a third plurality of analogue information channels corresponding to said analogue information channels; and combining said third plurality of analogue information channels into a single combined analogue audio signal which corresponds to analogue audio information signal.

3. The method of claim 1, further including the steps of:

generating a frequency modulated signal whose frequency lies between the frequencies of two of said information channels; and combining said frequency modulated signal with said second frequency modulated information channels during said step of combining said second frequency modulation information channels to form a single permutated analogue signal such that said frequency modulated signal provides synchronization information and serves as a frequency and amplitude reference.

4. The method of claim 2, further including steps of:

generating a frequency modulated signal whose frequency lies between the frequencies of two of said information channels; and combining said frequency modulated signal with said second frequency modulated information channels during said step of combining said second frequency modulation information channels to form a single permutated analogue signal such that said frequency modulated signal provides synchronization information and serves as a frequency and amplitude reference.

5. An apparatus for enciphering and deciphering analogue audio information, said apparatus comprising:

(A) an enciphering and transmitting substation for enciphering said analogue audio information and transmitting said enciphered audio information through a transmission medium, said transmission station comprising means for:

(1) subdividing said analogue audio information into a plurality of frequency bands, each of said frequency bands representing a different analogue information channel;

(2) converting each of said analogue information channels into a respective train of digital signals, each of said train of digital signals representing a different digital information channel;

(3) subdividing each of said digital information channels into a plurality of main blocks, each of said main blocks having the same time duration and being synchronous with a main block in each of the remaining said digital information channels;

(4) subdividing each of said main blocks into an equal number of subsections, each of said subsections being of equal time duration;

(5) permutating said subsections of each of said main blocks with subsections of its own main block and with subsections of other said main blocks which are synchronous therewith in accordance with key information so as to form a plurality of permutated digital information channels equal in number to said digital information channels;

(6) converting each of said permutated digital information channels into respective second analogue information channels; and (7) combining said second analogue information channels into a single permutated analogue signal and transmitting said single permutated analogue signal through a transmission medium;

(B) a deciphering and receiving substation for receiving said transmitted single permutated analogue signal and for deciphering said received signal permutated analogue signal to reform said analogue audio information, said deciphering and receiving substation comprising means for:

(1) receiving said transmitted single permutated analogue signal and separating said single permutated analogue signal into a third plurality of analogue information channels corresponding to said second analogue information channels;

(2) converting each of said third plurality of analogue information channels into respective reformed permutated digital information channels, each of said reformed permutated digital information channels comprising a plurality of subsections of equal time duration and corresponding to a different one of said permutated digital information channels;

(3) permutating said reformed permutated second digital information channels in accordance with key information so as to form a second plurality of digital information channels corresponding to said first plurality of digital information channels;

(4) converting each of said plurality of digital information channels into a third plurality of analogue information channels corresponding to said first plurality of analogue information channels; and (5) combining said third plurality of analogue information channels into a single combined audio signal which corresponds to said analogue audio information signal which was enciphered at said transmission substation.

6. The apparatus of claim 5, wherein said first means comprises:

(A) a plurality of bandpass filters equal in number to the number of said information channels, each of said bandpass filters adapted to pass a different one of said frequency bands;

(B) means for applying said analogue audio information to an input of each of said branching filters such that a different one of said frequency bands, corresponding to a different one of said information channels, appears at the output of each of said branching filters;

(C) a plurality of analogue to digital converters equal in number to the number of said branching filters, each of said analogue to digital converters receiving a different one of said frequency bands and generating a train of digital signals corresponding thereto;

(D) storage circuit means for receiving each said train of digital signals and for dividing each of said train of digital signals into said plurality of main blocks and for further dividing said plurality of main blocks into said plurality of subsections;

(E) key generator means for generating said key information;

(F) said storage circuit means also for permutating said subsections of each of said main blocks with subsections of its own main block and with subsections of other main blocks which are sychronous therewith in accordance with said key information so as to form said plurality of permutated digital information channels;

(G) a plurality of digital to analogue converters equal in number to the number of said permutated digital information channels, each of said digital to analogue converters associated with a different one of said permutated digital information channels and adapted to convert its associated permutated digital information channel into an analogue signal; and (H) means for combining said analogue appearing at the output of said digital to analogue converters into said single permutated analogue signal.

7. The apparatus of claim 6, wherein said second means comprises:

(A) a second plurality of bandpass filters equal in number to the number of said third plurality of analogue information channels, each of said bandpass filters adapted to pass a different one of said frequency bands;

(B) means for applying said transmitted single permutated analogue signal to an input of each of said second plurality of branching filters such that a different one of said frequency bands, corresponding to a different one of said third plurality of analogue information channels, appears at the output of each of said second plurality branching filters;

(C) a second plurality of analogue to digital converters equal in number to the number of said second plurality of branching filters, each of said second analogue to digital converters receiving a different one of said frequency bands appearing at the output of said second plurality of branching filters and generating a train of digital signals corresponding thereto;

(D) second storage circuit means for receiving each said train of digital signals and for dividing each of said train of digital signals into a second plurality of main blocks and for further dividing said second plurality of main blocks into said plurality of subsections;

(E) key generator means for generating said key information;

(F) said second storage circuit means also for permutating said subsections of each of said main blocks with subsections of its own main block and with subsections of other main blocks which are synchronous therewith in accordance with said key information so as to form said second plurality of digital information channels corresponding to said plurality of digital information channels;

(G) a second plurality of digital to analogue converters equal in number to the number of said second plurality of digital information channels, each of said digital to analogue converters associated with a different one of said second plurality of digital information channels and adapted to convert its associated digital information channel into an analogue signal; and (H) means for combining said analogue appearing at the output of said second plurality of digital to analogue converters into said analogue audio information signal.

8. The apparatus of claim 7 further including:

means for generating a frequency modulated signal whose frequency lies between the frequencies of two of said information channels; and means for combining said frequency modulated signal with said second analogue information channels to form a single permutated analogue signal such that said frequency modulated signal provides synchronization information and serves as a frequency and amplitude reference.

* * * * *